US006515586B1

(12) United States Patent
Wymore

(10) Patent No.: US 6,515,586 B1
(45) Date of Patent: Feb. 4, 2003

(54) TACTILE TRACKING SYSTEMS AND METHODS

(75) Inventor: Ben S. Wymore, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/216,580

(22) Filed: Dec. 18, 1998

(51) Int. Cl.[7] ..... G08B 13/00

(52) U.S. Cl. ..... 340/541; 340/540; 340/568.1; 340/665; 340/666; 340/686.1; 307/116; 307/119; 702/41; 702/139; 361/170; 361/189; 73/865.4

(58) Field of Search ..... 340/540, 541, 340/568.1, 665, 666, 686.1; 307/116, 119; 702/41, 139; 361/170, 189; 73/865.4

(56) References Cited

U.S. PATENT DOCUMENTS

| | | | | |
|---|---|---|---|---|
| 3,590,271 A | | 6/1971 | Peters | 307/140 |
| 3,757,322 A | | 9/1973 | Barkan et al. | 340/815.55 |
| 3,894,437 A | | 7/1975 | Hagy et al. | 73/172 |
| 4,075,616 A | * | 2/1978 | Rait | 340/541 |
| 4,467,391 A | * | 8/1984 | Refoy | 361/179 |
| 4,675,659 A | * | 6/1987 | Jenkins, Jr. et al. | 340/666 |
| 4,888,581 A | * | 12/1989 | Guscott | 340/666 |
| 5,033,291 A | | 7/1991 | Podoloff et al. | 73/172 |
| 5,060,174 A | | 10/1991 | Gross | 702/139 |
| 5,134,386 A | | 7/1992 | Swanic | 340/541 |
| 5,241,923 A | | 9/1993 | Janning | 119/721 |
| 5,253,656 A | | 10/1993 | Rincoe et al. | 600/595 |
| 5,570,301 A | | 10/1996 | Barrus | 702/150 |
| 5,666,157 A | | 9/1997 | Aviv | 348/152 |
| 5,671,362 A | * | 9/1997 | Cowe et al. | 340/568.1 |
| 5,678,448 A | | 10/1997 | Fullen et al. | 73/172 |
| 5,797,623 A | * | 8/1998 | Hubbard | 280/735 |

OTHER PUBLICATIONS

"Autotronics Product Review: The Next Step in Personal Security and Vehicle Tracking", *Motor Trend, 48,* 42, (Mar. 1996).

"Equipment Report IBM Home Director Lighting and Appliance Controller", *Electronics Now, 69,* Gernsback Publications Inc., 1–2 (Sep. 1998).

"Floors and Floor Coverings", *Microsoft(R) Encarta(R) 97 Encyclopedia (CD Rom),* (c) 1993–1996 Microsoft Corporation, 2 pages.

(List continued on next page.)

*Primary Examiner*—Jeffery Hofsass
*Assistant Examiner*—Tai T. Nguyen
(74) *Attorney, Agent, or Firm*—Schwegman, Lundberg, Woessner & Kluth, P.A.

(57) ABSTRACT

A tactile sensory system comprising a floor covering integrated with a tactile sensory layer to form a tactile sensory surface is described. The tactile sensory layer has a plurality of sensors. The system also comprises a controller connected to the tactile sensory surface to track a person or object. In one embodiment, the tactile sensory surface is flexible and is manufactured in bulk on a roll, so that it is adjustable in both length and width. Any type of sensors can be used, including pressure sensors, force sensors, force and position-sensing resistors, proximity sensors, and so forth.

24 Claims, 5 Drawing Sheets

OTHER PUBLICATIONS

Ayers, L., "Your PC is Listening. (Dragon System' Dragon Naturally Speaking Preferred 3.0 IBM's ViaVoice 98 Executive Edition, Lernout & Hauspie's Voice Xpress Plus and Philips Speech Processing's FreeSpeech 98 speech–recognition software)", *PC/Computing, 11,* Ziff–Davis Publishing Company, 1–3, (Sep. 1998).

Bass, S., "Automation Comes Home (PC World at Home)", *PC World, 13,* PC World Communications, Inc., 1–2, (Aug. 1995).

Gaddis, D., *Understanding & Installing Home Systems, How to Automate Your Home, Second Edition,* Printed in Oklahoma City, Oklahoma (Copyright pending), table of contents, (1991).

Howard, B., "Future Home Computers", *PC Magazine,* 158–160, (Mar. 25, 1997).

Johnson, L.R., "Intelligent Transportation Systems", *Microsoft(R) Encarta(R) 97 Encyclopedia (CD Rom),* (c) 1993–1996 Microsoft Corporation, 2 pages.

Kendall, G.S., et al., "A Spatial Sound Processor For Loudspeaker and Headphone Reproduction", *AES 8th International Conference,* 209–221.

Kruczynski, L.R., "Global Positioning System Satellite", *Microsoft(R) Encarta(R) 97 Encyclopedia (CD Rom),* (c) 1993–1996 Microsoft Corporation, 2 pages.

Mumford, S., "Don't Be (False) Alarmed", *Better Homes and Gardens,* 138, (May 1998).

Petruzzellis, T., ""New Film Sensor Technology", In: The Alarm, Sensor & Security Circuit Cookbook", *TAB Books, First Edition,* (1994).

Rogers, D.C., "Rugs and Carpets", *Microsoft(R) Encarta(R) 97 Encyclopedia (CD Rom),* (c) 1993–1996 Microsoft Corporation, 5 pages.

Stinson, C., "IBM ViaVoice 98 Executive", *PC Magazine, 17,* Ziff–Davis Publishing Company, 1–2, (Oct. 1998).

Wightman, F.L., et al., "Headphone Simulation of Free–Field Listening. I: Stimulus Synthesis", *Journal of Acoustical Society of America, 85,* Acoustical Society of America, 858–867, (Feb. 1989).

Winograd, T., "Towards A Human–Centered Interaction Architecture", http://acal.jf.intel.com/speakers/winograd.htm, 1–2, (Jul. 1998).

Zeltzer, D., "Virtual Reality", *Microsoft(R) Encarta(R) 97 Encyclopedia (CD Rom),* (c) 1993–1996 Microsoft Corporation, 2 pages.

* cited by examiner

TACTILE TRACKING SYSTEMS AND METHODS

FIELD

This invention relates generally to tracking systems, and in particular the present invention relates to tracking people or objects using surfaces equipped with tactile sensors.

BACKGROUND

Many systems have been proposed which track individuals and objects for a variety of different purposes. Home and business security, automation and monitoring systems, as well as industrial and factory control and communication systems are used to enhance, simplify or safeguard lives. Many such systems use computer vision techniques in which data from one or more video cameras is processed to obtain real-time tracking information. However, the presence of cameras can be intrusive and visually unappealing, particularly in a home environment. Furthermore, when intruders are aware they are being monitored, they can adjust their movements accordingly. Other devices which can be used to detect the presence of intruders include window foil, magnetic reed switches, motion sensors such as vibration detectors, light-beam sensors, infrared body heat sensors, and so forth. However, each of these devices are limited to one specific function and do not provide any means for unobtrusively tracking individuals or objects.

A commercially available system known as a global positioning system (GPS) can track the movements of individuals or objects, if the person or object to be tracked is equipped with a GPS receiver. At this time, the most precise form of GPS currently available to the public is about 45 m (about 150 ft), although most manufacturers guarantee up to only about 90 m (about 300 ft). Improved GPS satellites are expected to allow hand held receivers to determine positions to within 10 m (about 33 ft) or less. The GPS provides valuable information for navigational purposes, intelligent transportation systems, precision farming methods, and so forth. When integrated with a cellular telephone and a remote monitoring/response center, a GPS receiver/module can be used to provide personal security and vehicle tracking. However, due to its relatively limited accuracy and need for each object or individual being tracked to be equipped with a receiver, GPS is not appropriate or convenient for locally tracking individuals or objects within structures or other small areas.

Other methods for tracking individuals include the use of radio frequency (RF) transmitters and receivers. However, wearing a receiver can be cumbersome, particularly if it is not wireless, and such devices are not intended for automated monitoring of intruder movements. Objects can also be tracked for inventory purposes using computer-readable bar codes. However, such tracking systems first require application of a bar code label to the object, and further require the bar code to be scanned into a computer tracking system with a suitable scanning device before the object can be tracked.

For the reasons stated above, there is a need in the art for a less intrusive and more convenient and accurate system for tracking people or objects for security, automation, and monitoring purposes within structures or other small areas.

SUMMARY

A tactile sensory system comprising a floor covering integrated with a tactile sensory layer to form a tactile sensory surface is described. The tactile sensory layer has a plurality of sensors. The system also comprises a controller connected to the tactile sensory surface to track a person or object.

In one embodiment, the tactile sensory surface is flexible and is manufactured in bulk on a roll, so that it is adjustable in both length and width. Any type of sensors can be used, including pressure sensors, force sensors, force and position-sensing resistors, proximity sensors, and so forth.

DETAILED DESCRIPTION OF THE EMBODIMENTS

Figure 1:
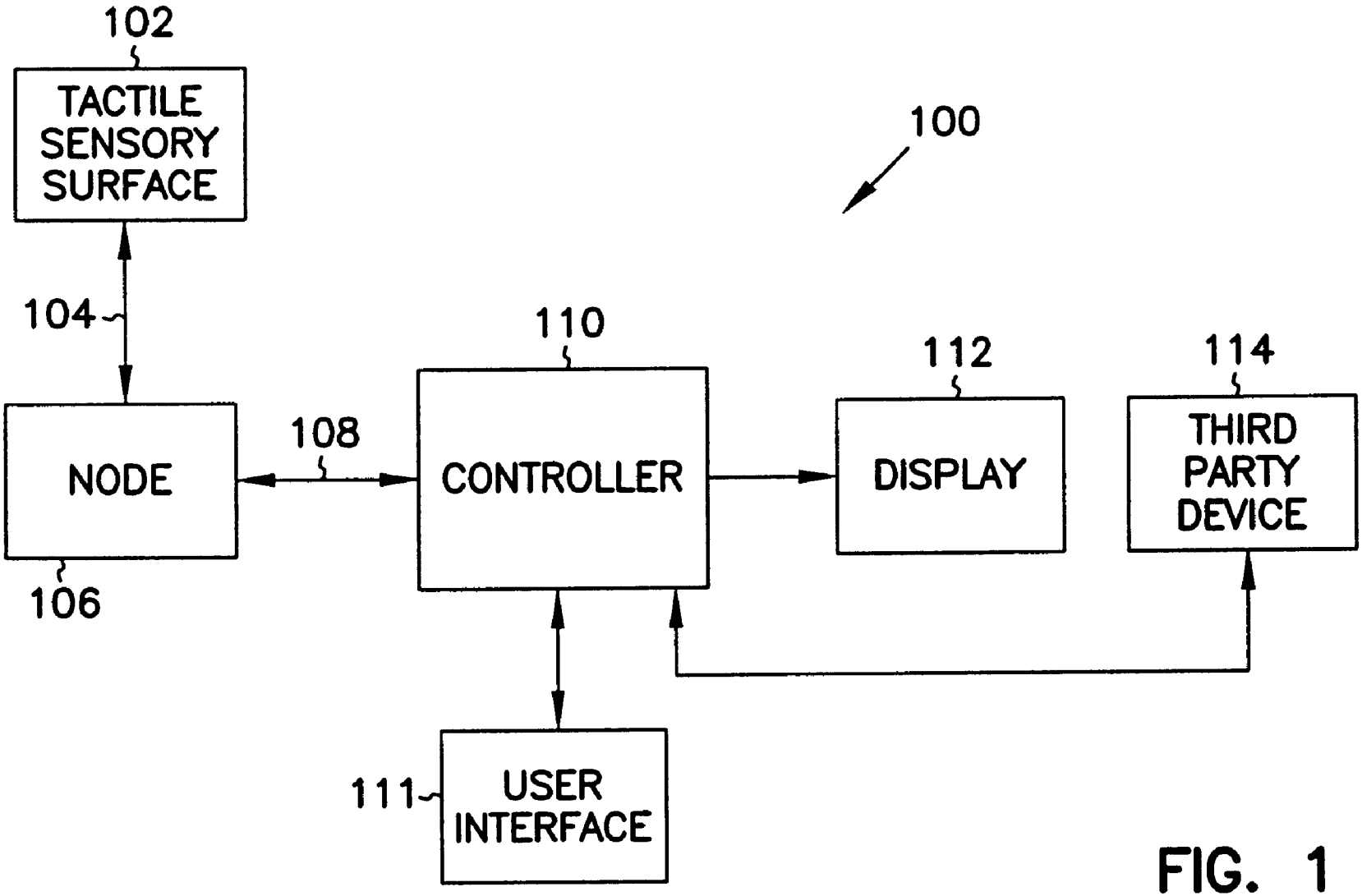
FIG. 1 is a block diagram of an automated tactile tracking system in one embodiment of the present invention.

In the following detailed description of the preferred embodiments, reference is made to the accompanying drawings which form a part hereof, and in which is shown by way of illustration specific preferred embodiments in which the inventions may be practiced. In the drawings, like numerals describe substantially similar components throughout the several views. These embodiments are described in sufficient detail to enable those skilled in the art to practice the invention, and it is to be understood that other embodiments may be utilized and that mechanical, procedural, electrical and other changes may be made without departing from the spirit and scope of the embodiments described. The following detailed description is, therefore, not to be taken in a limiting sense, and the scope of the embodiments described is defined only by the appended claims, along with the full scope of equivalents to which such claims are entitled.

Embodiments of the invention provide a tactile tracking system which eliminates the use of intrusive, inconvenient and encumbering apparatus such as video cameras, satellite equipment, bar codes or portable radio transmitters. Instead, the system uses an array or mesh network of sensors hidden beneath a surface to accurately determine the location or weight of an individual or object in an area where local tracking of individuals or objects is desirable. Local tracking using a tactile tracking surface can be used for security, monitoring or automating purposes, and includes tracking inside structures and in nearby outdoor areas. The sensors input information to a controller, and the controller can also be designed to work with existing automated third party devices, such as X-10 components, to provide for a complete communication system "X-10" refers to a power line carrier protocol known in the art that allows compatible device throughout a home to communicate with each other via existing 110V electrical wiring. The controller may be a personal or home computer system. Telephones or other personal communication devices may also be used to provide a user interface for the system.

Sensory technology is well-known in the art, and the term "smart" is often used to describe the ability of a component containing the appropriate electronics to "sense" certain changes in a surrounding environment and output this information in a manner which directly or indirectly causes a particular action. Tactile sensory technology is used in interactive/virtual reality environments, musical interfaces, diagnostic or sports training systems, traffic monitoring applications, and so forth. Tape-switch mats or sensor mats are often used in retail stores to summon a clerk or to protect specific valuables. The sensory surfaces used in these applications, however, are usually mats or pads of limited sizes, or, in the case of roadway sensory surfaces, are typically limited to detecting metals or magnetic fields. In contrast, the various embodiments provide area tactile sensory technology for locally tracking an individual or object inside structures and nearby outdoor areas.

Referring to FIG. 1, a block diagram of a computerized system 100 according to one embodiment of the invention is shown. The computerized system 100 includes a tactile sensory surface 102, a connector 104, a node 106, a transmission link 108, a controller 110, a user interface 111, and a display 112. The system 100 can also include linkage to third party devices 114 as shown in FIG. 1. Third party devices 114 can include alarms, remote sensing stations, appliances, lights, or devices such as security systems, sprinkler systems, and so forth. A suitable power supply can also be provided from any suitable source of energy such as a small generator, batteries or a normal power grid system, and so forth.

In one embodiment, the tactile sensory surface 102 is comprised of sensors and associated circuitry for transmitting and converting analog signals as described below in reference to FIG. 3. In an alternative embodiment, digital signals are output directly from the sensors, and at least one transmitter buffer is included in the circuitry. The connector 104 can be any suitable type of connector for connecting the tactile sensory surface 102 to the node 106. In one embodiment, the connector 104 converts sensor output from analog to digital form, such as a digital representation of an integer or floating point value, and transmits the digital representation to the controller 110 over the transmission link 108. In an alternative embodiment, a separate analog-to-digital converter is used to convert the analog signals from the sensors. The node 106 can be any type of device which can handle the interfacing between the tactile sensory surface 102 and the transmission link 108. This includes, but is not limited to, a computer, a microprocessor, any other suitable type of device having input and output capability, and so forth.

The transmission link 108 can be any suitable type of wired or wireless medium using any suitable bandwidth over which information can be transmitted. This includes, but is not limited to a parallel connection, a serial connection, thin or thick coaxial cable, twisted-pair wiring, copper wiring, a fiber-optic cable, including electro-optical fibers and integrated-optical fibers, a wireless connection using transmissions such as infrared or RF and so forth. The transmission link 108 can send and receive signals over any type of network operatively connected to the central controller 110, including a structure's existing alternating current (AC) wiring, telephone wiring or conventional cable TV wiring. In another embodiment, the network is a local area network (LAN), such as Ethernet, Asynchronous Transfer Mode (ATM), ring, token ring, star, bus, and so forth. In one embodiment, the transmission link 108 comprises a two-way whole structure Ethernet connection using standard protocol, such as Transmission Control Protocol/Internet Protocol (TCP/IP) having a bandwidth of about 10,000 kilobits per second. Use of a high speed LAN, such as an Ethernet network provides for high primary speed, thus allowing for fast location-based (or weight-based) feedback from the tactile sensory surface 102.

The controller 110 may be a local or remote receiver only, or a computer, such as a lap top general purpose computer or a specially-designed Application Specific Integrated Circuit (ASIC)-based controller as is well-known in the art. In one embodiment, the controller 110 is a personal computer having all necessary components for processing the input signals and generating appropriate output signals as is understood in the art. These components can include a processor, a utility, a driver, an event queue, an application, and so forth, although the invention is not so limited. In one embodiment, these components are all computer programs executed by a processor of the computer, which operates under the control of computer instructions, typically stored in a computer-readable medium such as a memory. In this way, useful operations on data and other input signals can be provided by the computer's processor. The controller 110 also desirably includes an operating system for running the computer programs, as can be appreciated by those within the art.

In one embodiment, there is no separate node 106, and the signals from the sensors are transmitted directly to the controller 110. In this embodiment, the controller 110 can include a transceiver and one or more multi-plexed analog-to-digital converters to read and convert sensor outputs directly. Alternatively, there can be a separate transceiver, such as a common RF transceiver or transmitter which transmits the analog signals from the sensors to the controller 110. Such a system can comprise an individual transmitter for each sensor or separate transmitters for each group of sensors. In such an embodiment, the signal for each sensor or group of sensors is transmitted directly to the controller 110 or to an intermediate, more powerful transceiver, which relays the signals to the controller 110. In the embodiment shown in FIG. 1, additional input and output signals are provided via the user interface 111.

As noted above, the user interface 111 can be any type of suitable communication device or transceiver, including, but not limited to, any type of telephone, key pad, keyboard, touch screen, and so forth. For example, the user interface 111 can comprise a telephone into which a user can speak in order to ask questions or issue directives, and through which the user can listen for responses from the controller 110. Such questions can include, for example, a request for information on the status of the sensors in a particular area or an inquiry as to the whereabouts of a particular person or object, and so forth. Directives can include instructions to activate a particular appliance, light, or any third party device. Responses from the controller 110 can include a computer-generated "voice" to answer the questions posed, as well as to confirm that the given directives have been carried out. Additional output signals can also be viewed on the display 112. In an alternative embodiment, the user interface 111 is only an input device for providing additional instructions to the controller 110 or requesting information from the controller 110. The resulting output signal can be viewed on the display 112, in this embodiment as well, as discussed in more detail below.

The output signal from the controller 110 can be provided in a variety of formats or attributes which can be determined or set by the user. For example, the display 112 can be a monitor projecting real-time information as to the status of each sensor, row of sensors, and/or each individual area equipped with a tactile sensory surface 102. Alternatively, the display 112 may not show the position of a sensor until it has been activated or may show the decay of an attribute, indicate information on direction or size of an object or individual, and so forth. The display 112 can also depict a graphical representation of the space being monitored with each sensor portrayed in a particular color, depending on whether or not it has been activated and, in some cases, the degree of activation. The display 112 can indicate sensor status by a particular type or rate of blinking, and can include audible indications alone or in combination with other visual representations. The display 112 can further include the status of third-party devices 114 to which the system 100 is connected and to which the controller 110 has provided output signals directly.

Figure 2:
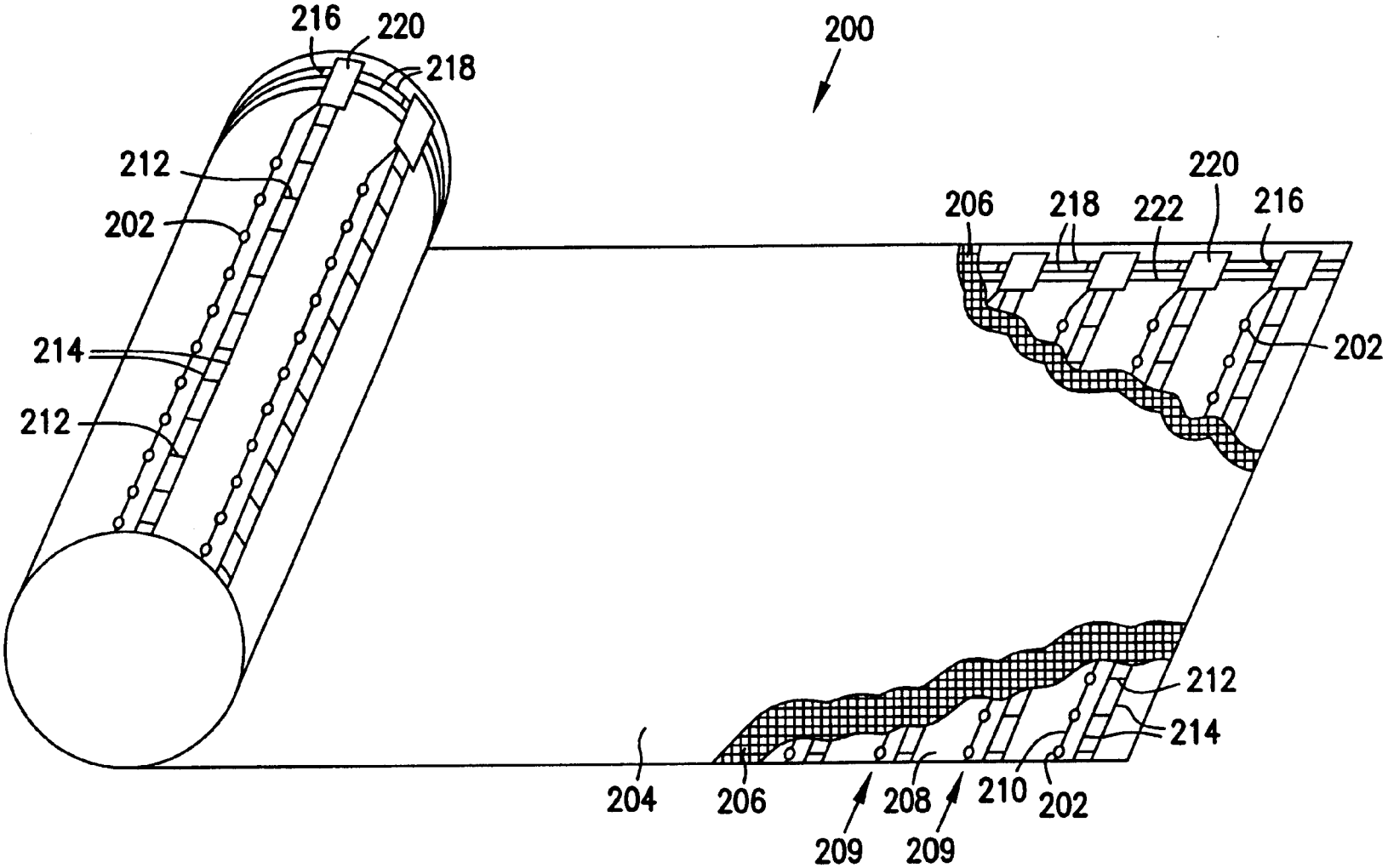
FIG. 2 is a simplified schematic illustration of a bulk roll of a tactile sensory surface in one embodiment of the present invention.

The tactile sensory surface 102 can be any type of surface into which tactile sensors and associated leads from the contact areas to the perimeter can be integrated. FIG. 2 shows one embodiment in which the tactile sensory surface 102 is flexible, such that it can be rolled into a bulk roll 200 prior to distributing to wholesalers and retailers. In the embodiment shown in FIG. 2, the tactile sensory surface 102 is comprised of three layers consisting of a surface layer 204, a backing or foundation layer 206, and a sensory layer 208. In an alternative embodiment, the sensory layer 208 is located between the surface and backing layers, 204 and 206, respectively. In another alternative embodiment, the sensors 202 are integrated directly into the top or bottom side of the backing layer 206 at the time of manufacturing. In yet another alternative embodiment, the surface layer 204 is a carpet, and the sensors 202 are woven directly into the carpet fibers.

The surface layer 204 can be sold in any length or width, including standard carpet and linoleum widths for wall-to-wall or other area installation, such as about 3.6 m (about 12 ft) or about 4.5 m (about 15 ft). The term "area" can be a wide area, and is considered to include any or all of an "open" area not otherwise covered by furniture, cabinets or appliances. An "area" tactile sensory surface includes any room-sized or wall-to-wall floor covering. In some cases, an "area" may include only high traffic areas in a particular room or area. An "area" is also considered to include outdoor areas which surround the structure including yards, playing fields, structure perimeters, and so forth.

Examples of conventional surfaces which can be used as the surface layer 204 include, but are not limited to, any type of handmade or factory-made carpeting, rug, mat, wood or simulated wood flooring, linoleum, rubber, tile, cork, any type of deck, porch, patio or walkway surfaces, including concrete, brick, railroad timber, synthetic-turf carpeting ("artificial turf"), and so forth, further including any type of commercial floor or floor covering, such as industrial, residential development or business floor or floor covering. Tactile sensors can also be integrated into specific high traffic areas, such as thresholds, or other areas which are not typically at groundlevel, including, but not limited to, any type of furniture, appliance, door, window, railing, window sill, and so forth.

In one embodiment, the surface layer 204 is a heavy fabric made of various materials which can be weaved, braided, knitted, sewn, tufted, glued, or otherwise manufactured into a carpet, rug, or mat. Such materials, include, but are not limited to natural fibers, such as cotton or wool, or synthetic fibers such as nylon, acrylics, modacrylics, olefins (polypropylenes), rayon, polyesters, or a combination of natural and synthetic fibers. In one embodiment, the surface layer 204 is comprised of a flat-woven fabric. In an alternative embodiment, the surface layer 204 is comprised of a hand-knotted or factory-produced pile fabric having a strong backing layer 206 of ordinary weave as is known in the art, but with added threads to form a raised surface.

The distinction between "carpets" and "rugs" is indefinite, but is typically considered a matter of size and method of attachment. In general, rugs are smaller than carpets, cover only a portion of the floor area, and are not secured to the floor. Carpets are generally secured to the floor by tacking, glueing, cementing, and so forth. Unless the carpeting is for high-traffic commercial or indoor/outdoor use, the carpet is typically laid on top of a suitable foam pad or cushion rather than directly onto the floor. "Broadloom" carpets and rugs are defined in the art as including wall-to-wall carpeting and rugs larger than about 1.2 by about 1.8 m (about four (4) by six (6) ft). "Scatter" rugs include smaller area rugs, and "miscellaneous" rugs are considered to include door mats, bath mats, automobile carpets, and so forth.

The backing layer 206 can be comprised of any suitable material as is known in the art. In the embodiment shown in FIG. 2, the backing layer 206 is a loose weave material, such as burlap, attached to or integrated with the surface layer 204 in any suitable manner. In another embodiment, the backing layer 206 is a latex rubber material. In an alternative embodiment, a secondary backing material is added for added strength and dimensional stability, and can be used to hold individual tufts of fabric in place. In another alternative embodiment, a high-density foam rubber, vinyl cushion or sponge material is used in place of a secondary backing material. In yet another alternative embodiment, there is no backing layer 206, such as with braided rugs, and the sensory layer 208 is integrated with the underside of the surface layer 204.

The sensory layer 208 can include a backing sheet or film onto which the sensors 202 and associated circuitry are attached or integrated. In one embodiment, the sensors 202 are glued to the backing sheet using a suitable adhesive material, prior to being integrated with the conventional backing layer 206. In an alternative embodiment, the electronic components of the sensory layer 208 are encased in a waterproof housing, such as between two layers of thin film or any type of laminate material.

In the embodiment shown in FIG. 2, the sensory layer 208 comprises a plurality of sensors 202, sensor leads 210, width resistor indicators 212 width resistor wire pairs 214, length resistor indicators 216, a length resistor wire pair 218, multiplexers (or row multiplexers) 220 and a data bus 222. The sensors 202 can be arranged in any suitable pattern or field, including, but not limited to a grid pattern, hexagonal pattern, and so forth. The sensors 202 can further be of any suitable size and be any suitable distance apart, depending on the particular application. When placed in rows, the sensors 202 can be arranged in any suitable manner, including horizontally, vertically or diagonally. In the embodiment shown in FIG. 2, the sensors are arranged in rows 209 to form a grid, and run across the width of the tactile sensory surface 102. Each separate row 209 of sensors 202 can be spaced the same distance apart as the distance between individual sensors 202 in a row 209, so as to form a square grid pattern, although the invention is not so limited. In one embodiment, the sensors are about one (1) cm to about 2.5 cm (about 0.5 in to about one (1) in) in diameter and are arranged in rows 209 as shown, with spacing between sensors of about 0.5 cm to ten (10) cm (about 0.25 in to four (4) in) or less within each row 209.

Within a given row 209, there are a suitable number of sensors 202 connected to at least one row multiplexer 220 via one or more sensor leads 210. The sensor lead 210 can comprise one continuous wire as shown in FIG. 2, or can include a series of wires running between each sensor 202, such that there is a small gap within the diameter of the sensor 202 where a wire or sensor lead 210 is not present. Each sensor 202, when activated, sends out a particular signal to the row multiplexer 220 for that row, depending on the type of sensor 202, and in some cases, the degree of activation.

In the embodiment shown in FIG. 2, there is one width resistor indicator 212 associated with each sensor 202. The width resistor indicators 212 can be resistors which are in parallel with each other and communicate with the same row multiplexer 220 as the sensors 202 in a given row 209, via a-width resistor wire pair 214. The width resistor wire pair 214 is shown in running in parallel to the sensor row 209 in FIG. 2, although the invention is not so limited. Specifically, the width resistor indicators 212 provide information to the row multiplexer 220 as to the total number of sensors 202 in a particular row 209. The row multiplexers 202 in turn, pass on this information to the node 106 as noted above. In one embodiment, each row multiplexer 220 is essentially a controller, and is programmed to know the total resistance of all of the width resistor indicators 212 running between the width resistor wire pair 214 for that row, such that it can determine how many width resistor indicators 212 are in parallel in its row. In this way, the width of the tactile sensory surface 102 can be determined, and it is this information which is communicated to the node 106. Similarly, and as shown in the embodiment in FIG. 2, there is one length resistor indicator 216 associated with each row multiplexer 220. The length resistor indicators 216 can be resistors which are in parallel with each other and communicate with the same node 106 as the row multiplexers 220 via a resistor wire pair 218. The length resistor wire pair 218 is shown running in parallel to the line of row multiplexers 220 in FIG. 2, although the invention is not so limited. Specifically, the length resistor indicators 216 provide information to the node 106 as to the total number of row multiplexers 220 present. In this way, the length of the tactile sensory surface 102 can be determined. In an alternative embodiment, each length resistor indicator 216 provides information as to the existence of a particular row 209 directly to the row multiplexer 220 with which it is associated. In this embodiment, each row multiplexer 220, in turn, transmits this information to the node 106. The data bus 222 serves to connect all of the row multiplexers 220. Once installed, the data bus 222 will transmit data from the row multiplexers 220 to the controller 110 as described in FIG. 3 below.

In an alternative embodiment, there are no width resistor indicators 212 or width resistor wire pairs 214, and each sensor 202 in a particular row 209, polls the nearest sensor 202 in a particular direction to determine whether or not a neighboring sensor exists. The resulting information can be provided by the polling sensor 202 to its row multiplexer 220. Similarly, the length resistor indicators 216 and the length resistor wire pair 218 can be eliminated, and each row multiplexer 220 can poll the nearest row multiplexer 220 in a particular direction to determine whether or not a neighboring row multiplexer 220 exists. The resulting information can be provided by the polling row multiplexer 220 to the node 106. In another alternative embodiment, the length and width resistor indicators, 212 and 216, respectively, are made from fiber optics and a timing loop is used to determine how many sensors 202 are in a particular row 209 and how many rows 209 are in a particular tactile sensory surface 102, respectively.

Any number of sensors 202 can be organized in an array of any size, such as an m×n matrix having m rows and n sensors designated, respectively, $R_1$–$R_m$ and $S_1$–$S_n$. FIG. 3 shows a tactile sensory surface section (hereinafter "section") 302 after it has been cut from the bulk roll 200 (shown in FIG. 2) along line 303, leaving a fixed number of rows 209 and length resistance indicators 216, such that the length of the tactile sensory surface 102 can be determined. This particular section 302 has also been cut along line 304 so that the excess width 306 can be removed prior to installation.

Figure 3:
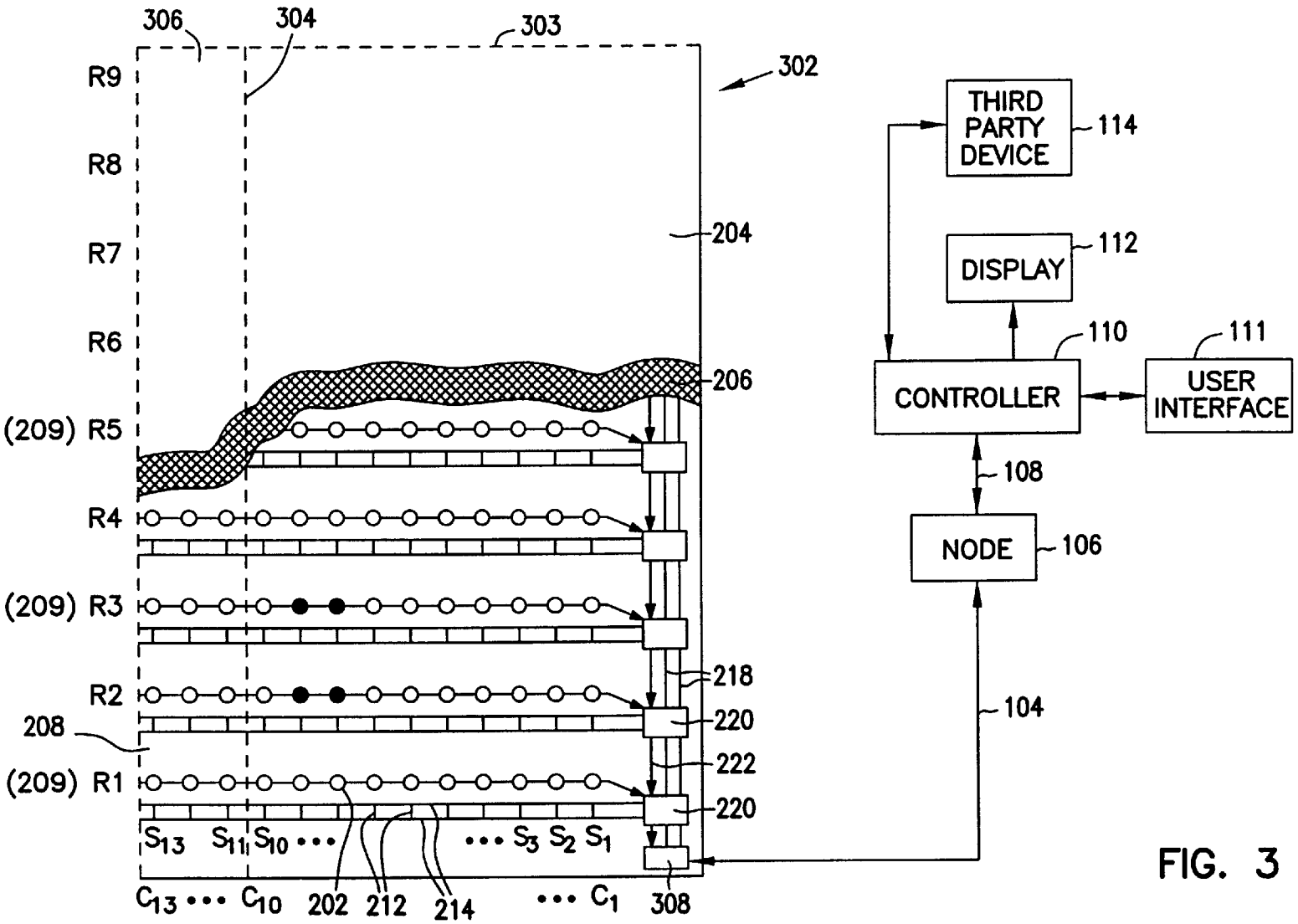
FIG. 3 is a simplified schematic illustration of a section of the tactile sensory surface cut from the bulk roll in one embodiment of the present invention.

The section 302 shown in FIG. 3 originally had nine (9) rows 209 of sensors 202 and thirteen sensors 202 in each row 209. After being cut along line 304, the section 302 still has nine (9) rows 209 of sensors 202, but only ten (10) sensors 202 in each row 209, i.e., $S_1$–$S_{10}$. The excess width 306, containing the nine rows 209 of sensors ($S_{11}$–$S_{13}$) 202 can then be discarded or recycled for use elsewhere. In this embodiment, the section 302 has been cut to reduce its width on the side "away" from the row multiplexers 220, so as to leave intact the row multiplexers 220, data bus 222, length resistor indicators 216, and length resistor wire pair 218.

By removing the sensors 202 and their associated width resistor indicators 212 when cutting along line 304, the resistance across each width resistor wire pair 214 in FIG. 3 is increased accordingly. Further, the total resistance for a given number of resistors in parallel is determinable according to known mathematical relationships. When in operation, therefore, this increased total "width" resistance, corresponding with the new, decreased width of a particular row 209, is communicated to that row's multiplexer 220 (or a row controller) via the width resistor wire pair 214. This increased total "width" resistance directly corresponds with the new, reduced number of sensors 202 in that row 209. In the embodiment shown in FIG. 3, the total "width" resistance is the same for each row 209 in the section 302, since the straight cut along line 304 resulted in ten sensors 202 remaining in each row 209 of the section 302. Similarly, the resistance across the length resistor wire pair 218 increases when the length of the section 302 is decreased. A total increased "length" resistance, corresponding with a new, reduced number of rows 209 in the section 302, can be communicated to the node 106 via the length resistor wire pair 218. In the embodiment shown in FIG. 3, the total "length" resistance is communicated to the node 106 via the nine length resistor indicators 216 (seen in FIG. 2) located at the end of each of the nine rows 209 ($R_1$–$R_9$) in section 302. In this way, the total surface area of a particular section 302 can be determined, so that accurate information can be input into the controller 110, and ultimately provided to the user as to the location of an object or individual on the tactile sensory surface 102.

The tactile sensory surface 102 can also be cut in a non-rectangular fashion at any angle across its length and width, as long as the remaining resistor indicators are not separated by the cut, i.e., as long as all remaining width resistor indicators 212 are still in communication with their respective row controllers 120 and all remaining length resistor indicators 216 are still in communication with the node 106. In this embodiment, every row 209 in a particular section 302 does not necessarily have the identical number of sensors 202. The cut can also be made in any type of curved fashion, as long as the above constraints are kept in mind. In this way, the geometry of a particular section 302 can be of a variety of shapes and sizes, such as a polyhedron, circle, semi-circle, oval, and so forth. In such embodiments, the data bus 222, length resistor indicators 216 and length resistor wire pair 218 can be located other than near an edge, if necessary, such that each field or row is divided into two sections, each on either side of this circuitry. In one embodiment, the tactile sensory surface 102 is cut at about a 45 degree angle across its width.

The width and length resistor indicators, 212 and 216, respectively, can have any suitable amount of resistance needed for a particular type of tactile sensory surface 102 and a particular application. Further, any suitable number of width and length resistor indicators, 212 and 216, respectively, can be used in a particular section 302, as long as the tolerance is acceptable for the particular application.

The tactile sensory surface 102 can be installed in the conventional manner for the particular surface layer 204 and backing layer 206. If a broadloom carpet or rug is being installed, a foam pad or cushion can first be installed prior to installing the tactile sensory surface 102. Installation can include connecting the transmitter or edge connector 308 to the tactile sensory surface 102. Once the tactile sensory surface 102 is in place, its electrical components can be connected to the external hardware shown in FIG. 3, as well as to a separate power supply, if necessary. Specifically, the transmitter 308 can be connected to the connector 104 which in turn, is connected to the node 106. The node 106 can then be connected to a portable controller provided by the installer, so that information, such as the appropriate TCP/IP protocol can be input, for example, if an Ethernet network is being used. Information received by the node 106 is then communicated via the transmission link 108 to the controller 110 as discussed above. Preferably, the network wiring is laid at the time the building is being constructed, although this is not necessary. In an alternative embodiment, the sensors 202 are connected to the controller 110 through other suitable wiring systems, including, but not limited to, cable TV wiring, AC wiring, or even wireless systems as discussed above.

In most applications, the sensors 202 are not noticeable to the user, once the tactile sensory surface 102 is installed, such that tracking of an individual or object can be accomplished in a non-intrusive manner. In one embodiment, the array of sensors 202 is designed to be low-profile in order to prevent or minimize lumpiness or unevenness in the tactile sensory surface 102. The sensors 202 can be any suitable type of sensors 202, such as force sensors or pressure sensors. Although the terms "pressure" and "force" are often used interchangeably in the art, by definition, a "force" sensor gives a constant force reading independent of the area over which the force is applied. Force sensors include, but are not limited to, piezo polymers and ceramic strain gauges. A pressure sensor gives the same constant force reading, which is inversely proportional to the area of the applied force. In one embodiment, the sensors 202 are responsive to variable pressures and can be adjusted in sensitivity depending on a particular application. In an alternative embodiment, the sensors 202 are binary "on/off" sensors having a minimum threshold pressure needed to activate depending on the usage. In one embodiment, the minimum threshold pressure is less than about seven (7) bars (about 0.5 psi), up to about 1.5 bars (about 10 psi) to about 15 bars (about 100 psi) or more. In a particular embodiment, each sensor 202 is comprised of layers of material which can detect contact pressure or whose electrical resistance or capacitance changes with an increase in pressure applied to the sensor 202. Such materials include, but are not limited to thin film sensors, such as piezo film. Piezo film is available in a wide variety of thicknesses and configurations, and is known to be flexible, lightweight and durable.

Another type of thin film sensor which can be used is a sensor device known as a force and position-sensing resistor (FSR). As the name implies, this device can detect both force and position, and typically displays a resistance of the square root of the area of the applied force. Two basic types of FSRs include an FSR-LP linear potentiometer and an "XYZ" pad. The FSR-LP has conducting fingers shunted by a conductive polymer, such that a greater number of shunted fingers produces a greater dynamic range and resolution. The XYZ pad or tablet is essentially two FSR-LPS set back-to-back. FSR devices are known to be impervious to moisture, chemicals, vibration and magnetism. The FSR device used can be of any suitable size and shape. The current should be set at a level appropriate for the intended use. In one particular embodiment, the current through the FSR is less than about one (1) A/cm$^2$ of footprint activation. FSR devices typically exhibit a resistance change from about one (1) k-ohm to about ten (10) M-ohm and respond to pressures between about 0.15 bar (about 0.01 psi) to about 1450 bar (about 100 psi), depending on the particular type of FSR being used. In a particular embodiment, the sensors used are FSR devices from Interlink Electronics in Camarillo, Calif.

In another alternative embodiment, the sensors are proximity sensors which detect motion near, but not touching a sensor. In a particular embodiment, sensors developed by the Media Lab of the Massachusetts Institute of Technology in Cambridge, Mass., are used. In yet another alternative embodiment, the sensors are Hall-effect sensors which detect metals and magnetic fields. Other types of sensors may include pyroelectric or passive infrared sensors, and so forth. In one embodiment, the conventional backing layer is relatively rigid, such as a stiff pad or even subflooring, and sensors are used which can detect the arrival time of pressure waves. Alternatively, the sensors can send out timed sound waves from several places at the border, similar to the manner in which a touch screen operates, which is well-known in the art. Any combination of the above-described sensors or other sensors known in the art can be used, depending on the particular environment and type of tracking desired.

The signals from each sensor 202 can be transmitted in any suitable way to the controller 110 using electrical circuity known in the art. In the embodiment shown in FIGS. 2 and 3, a data bus 222 is used to connect a plurality of row multiplexers 220. The data bus 222 can be any suitable type of bus, such as a multi-line high speed data bus capable of rapidly transferring many different types of information. In one embodiment, the data bus 222 has a low profile and the data bus lines are of sufficient thickness so that the transmitter 308 can be clamped onto it, as discussed below. The data bus 222 can be installed near the edge on the underside of the tactile sensory surface 102. The row multiplexers 220, in turn, are used to access each sensor 202 in a given row 209 according to its column position ($C_1$–$C_{10}$). In one embodiment, the row multiplexers 220 also have a low profile and are attached to the data bus 222 near the edge on the underside of the tactile sensory surface 102.

As shown in FIG. 3, the output of the row multiplexer 220 for row three ($R_3$) 209, for example, corresponds to sensors $S_1$–$S_{10}$ (202), which are in columns 1–10, of row three ($R_3$) 209. In an alternative embodiment, the multiplexing circuitry also includes a column multiplexer (not shown) which receives input from all of the row multiplexers 220, and can select a specific data line corresponding to a particular column ($C_1$–$C_{10}$), as commanded by the node 106. In this embodiment, read or scan events initiated by the node 106 can include input from both the row multiplexers 220 and the column multiplexer.

The edge connector or transmitter 308 can be any suitable type of transmitter 308, including a conventional wired or wireless transmitter or a fiber optic transmitter. In one embodiment, the transmitter 308 is a crimp-on connector which grabs on to the data bus 222, and has a low profile so as not to cause a perceptible ridge or bump in the carpet. In an alternative embodiment, there is no separate transmitter 308 and the node 106 is connected directly to the data bus 222.

The node 106 can be of any suitable size and shape and installed in any suitable manner. In one embodiment, the node 106 fits into an outlet-sized box that fits within the wall of the structure. In an alternative embodiment, the node 106 is connected to the exterior of the structure.

Figure 4:
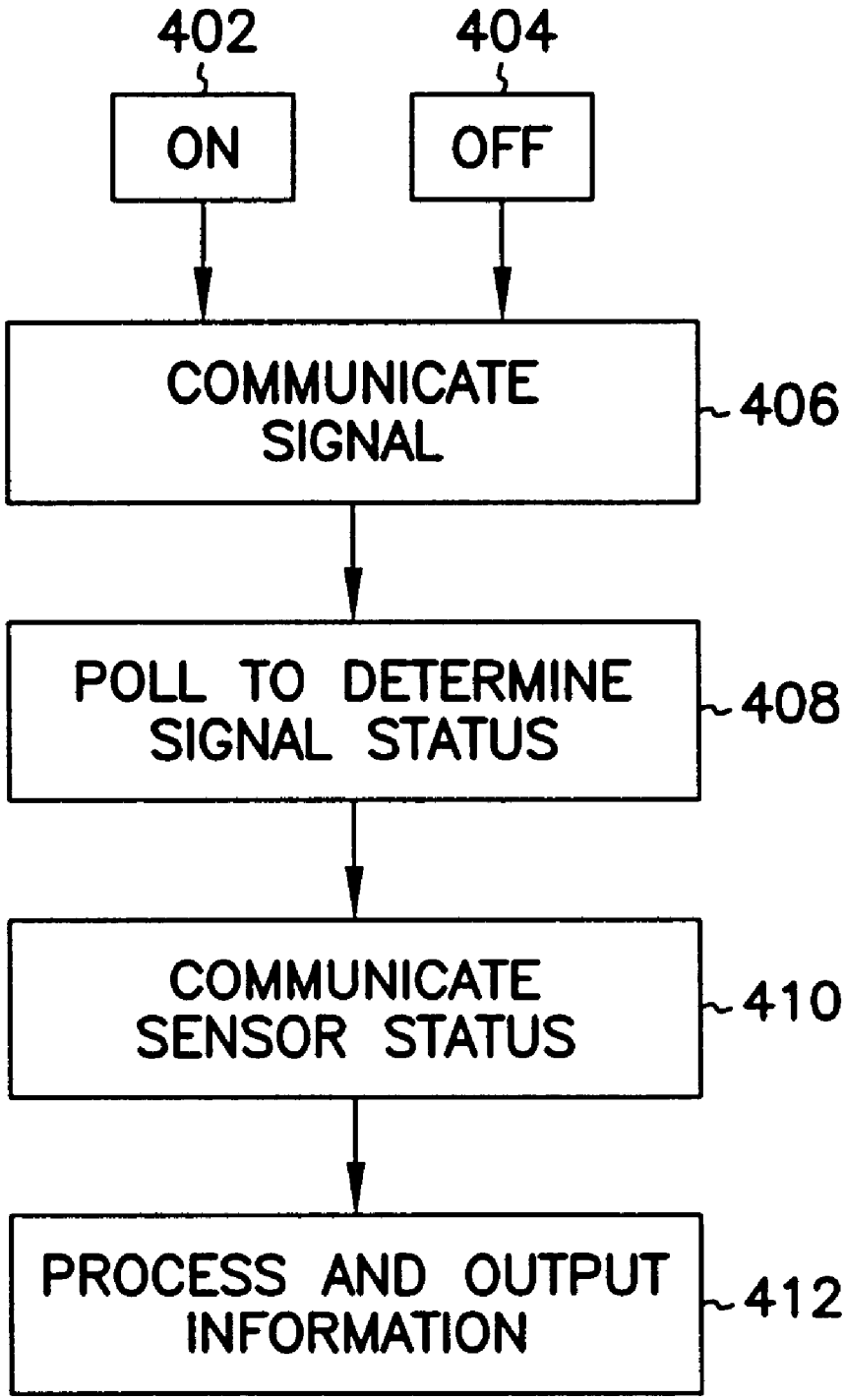
FIG. 4 is a flow chart describing steps for operating the tactile tracking system in one embodiment of the present invention.

In operation, one or more sensors can be used to track an individual or object, such that at any given point in time some sensors will be activated and some will not. FIG. 4 depicts a flow chart for use of a tactile sensory surface in one embodiment. The process may take many forms, although for simplicity, it is assumed that there are two sensors which are on/off sensors, and at this particular point in time, one sensor is turned "on" and a second sensor remains "off" as shown in steps 402 and 404, respectively. The respective status for each sensor is then communicated via sensor leads to the multiplexer as shown in step 406. In one embodiment, the sensors are analog pressure sensors which send a pressure data signal proportional to the pressure sensed by each of the sensors. At about the same time, the multiplexer is polled by the node to determine the status of the sensors as shown in step 408. The monitoring or polling can be performed continuously, periodically, on demand, upon the occurrence of a selected event or at any other time within normal system design. Such sampling necessarily requires that the node has memory for storing pressure or other data from each sensor during each read event, with the data being correlated to the location of the respective sensors. The process continues when the sensor status is communicated to the central controller as shown in step 410. Finally, the central controller processes and outputs information, depending on the particular application and attributes set by the user, as shown in step 412.

Referring again to FIG. 3, two sensors ($S_8$ and $S_9$) 202 in rows two and three ($R_2$ and $R_3$) 209 have been activated. When polled by the node 106, the status of each of the sensors 202, including the ones which have been activated, is communicated to the controller 110, and in some cases, to the third party device 114, and to the user interface 111 as described above. Depending on how the controller 110 has been programmed, the information regarding the activation of these particular sensors 202, may cause an alarm to be sent to a remote sensing station, or may otherwise be stored until further input is received, such as a voice command instructing that a specific light be turned on. Since the location of the activated sensors 202 is known, the appropriate signal can then be generated to turn on the light nearest to the activated sensors 202. The number of sensors 202 which need to be activated in order to cause the desired response in the controller 110 will vary depending on the type and spacing of the sensors 202, as well as on the particular application. In some applications it may be necessary to set a predetermined minimum number of sensors 202 which must be activated prior to a particular output being initiated by the controller 110 to avoid false alarms from small pets or other objects. Alternatively, the sensor sensitivity can be adjusted so as to be responsive only above a level exceeding inputs from unintended objects, individuals or small animals.

It is possible to input additional information into the controller through the user interface 111 as discussed above. Further, appropriate signals can be output through any number of third party devices 114, or user interface 111 as known in the art, in order to fully automate the tactile tracking system 100. In one embodiment, the user interface 111 comprises any type of transceiver, such as a two-way radio or telephone, which accepts voice commands from the user and transmits the associated signal to the controller 110. In such an embodiment, the controller 110 has the appropriate voice recognition software operating therein. In an alternative embodiment, additional input can be given by tapping a foot on the tactile sensory surface 102 while issuing a voice command.

Similarly, output from the controller 110 can be linked with other third party devices 114, including, but not limited to static-electricity detectors, light and heat detectors, temperature sensors, humidity sensors, metal and magnetic sensors, vibration switches, magnetic switches, infrared sensors, carbon monoxide detectors, smoke detectors, and so forth. Other types of third party devices 114 to which the controller 110 can be attached include appliances, lights, (or their respective modules), alarm or alert devices, sprinkler systems, home and business security systems, digital weight scales, chimney alarms, and so forth. These and other third party devices 114 are described in the book by Thomas Petruzzellis, entitled, "The Alarm, Sensor & Security Circuit Cookbook," Blue Ridge Summit, Pa., published 1994.

Figure 5:
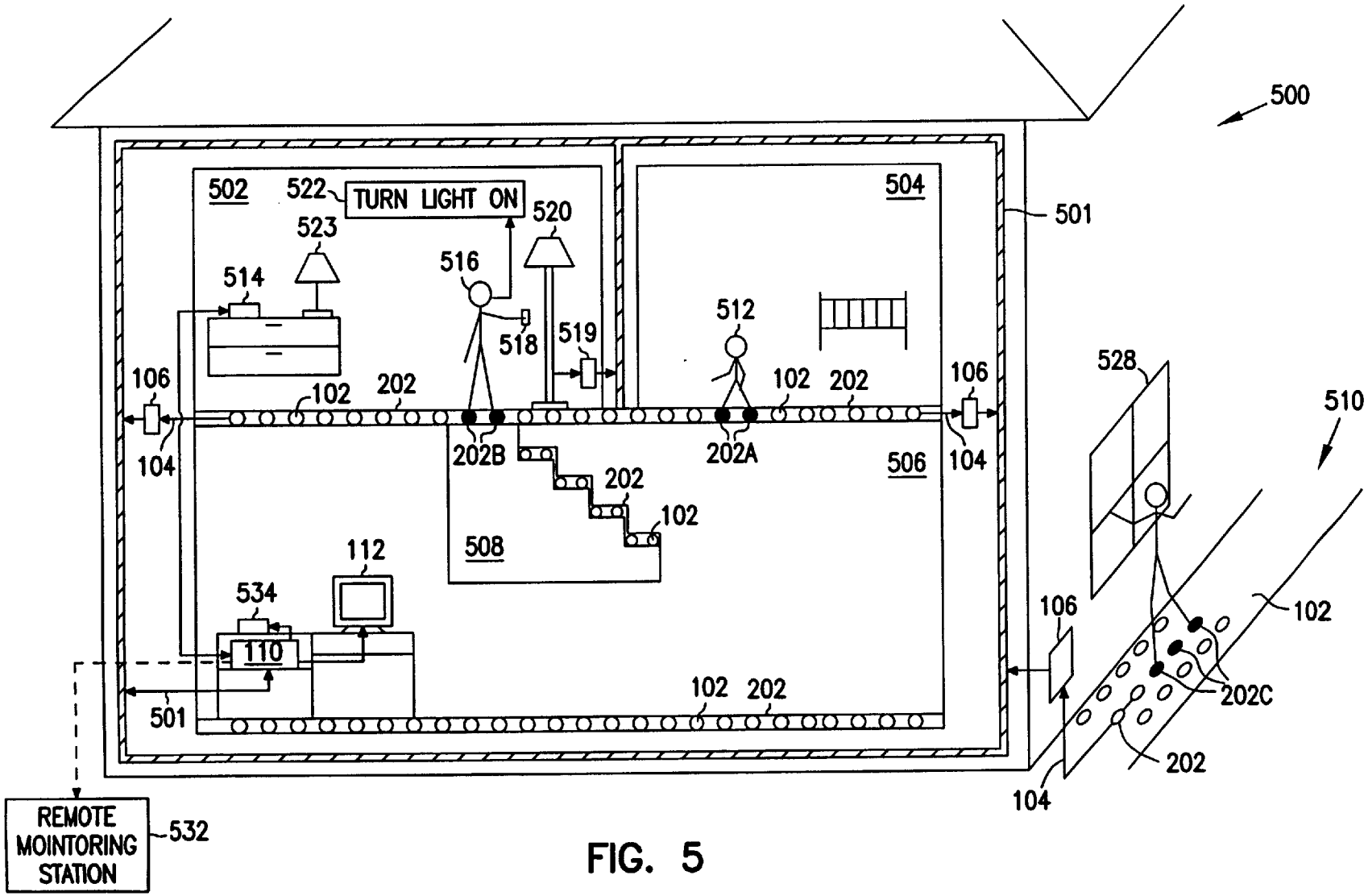
FIG. 5 is a simplified schematic illustration of a tactile tracking system being used for automating, monitoring and security purposes in a home environment in one embodiment of the present invention.

FIG. 5 shows a home 500 equipped with a home network 501, multiple tactile sensory surfaces 102 and associated circuitry including connectors 104 and nodes 106 according to one embodiment. In this embodiment, a tactile sensory surface 102 using binary on/off sensors 202 and the associated circuitry is present in a master bedroom 502, a nursery 504, a main level 506, a staircase 508 and an outside perimeter 510. The controller 110 is currently set for "nighttime" monitoring, which in this particular embodiment, means that a scan on the sensor status is performed continuously by each of the nodes 106 located in the master bedroom 502, the nursery 504, and on the exterior of the home near the perimeter 510. Information as to the status of the sensors 202, as well as each area having a tactile sensory surface 102 can be continuously output to a display monitor 112.

At this particular point in time, the system is actively detecting inputs in three separate locations and providing three separate outputs, in addition to the output to the display monitor 112, according to a previously determined set of instructions. A child 512 in the nursery 504 is apparently out of bed, causing certain sensors 202A in the tactile sensory surface 102 on which the child 512 is stepping to turn "on." As a result, information is input into the controller 110 regarding the status and location of the activated sensors 202A in the nursery 504. In response, the controller 110 has activated a baby alert module 514 in the master bedroom 502. Very shortly thereafter, and in response to the sound from the baby alert module 514, an adult 516 in the master bedroom 502 is talking into a telephone 518 designed to transmit voice commands to the controller 110. The adult 516 is requesting that a first light 520 be turned on, by saying the phrase, "turn light on" 522. The pressure of the adult's feet on the tactile sensory surface 102 causes certain sensors 202B to turn "on" in the master bedroom 502 and this information is input to the controller 110. Since the controller 110 is receiving the sensory input from a specific location within the master bedroom 502, it is able to respond to the voice command by activating a module 519 connected to the light nearest the adult 516, which is the first light 520, and not a second light 523, as shown. Simultaneously, an intruder 526 is attempting to gain access to the home 500 through a first floor window 528. However, the pressure of the intruder's feet on the tactile sensory surface 102 installed underneath the artificial turf installed around the perimeter of the home 500 causes certain sensors 202C to turn "on" in the usual manner. In response, the controller 110 outputs an alarm signal to a remote monitoring station 532 and also projects an audible alarm sound within the home 500 through an associated alarm or security system 534. Through use of devices such as the baby alert module 514, light module 519, and alarm system 534, the tactile tracking system provides a complete communication system for monitoring, automating and security purposes, respectively.

As noted above, the tactile sensory surface can also be used to determine the weight of people or objects. Such an embodiment has application in industry or warehouses such that the amount of inventory can be determined on the basis of the weight reading generated by the sensors. Pieces of machinery having a known weight can also be located by viewing the output. Alternatively, the weight distribution of the machinery can be programmed into the central controller, such that a user can determine the location of the machinery by inputting queries in the appropriate format into the central controller, such as, "where is forklift A?"

With the appropriate type of sensor, associated circuitry, and programming into the controller it is possible to not only determine the presence or weight of an individual or object, but also the weight distribution or foot size and shape associated with a particular individual. Such embodiments would likely require a closely packed sensor distribution, such as a spacing of about 0.6 cm to about 2.54 cm (about 0.25 in to about one (1) in) or less between sensors. With further programming, the gait of a particular individual can also be recognized as the individual moves across the tactile sensory surface. Such embodiments provide enhanced methods for automating, monitoring and security purposes by allowing for user identification.

The unique tactile sensory surface allows for dynamic wide area real-time measurements of sensor activation without the need for video cameras, satellites, conventional radio transmitters, and so forth. The method and apparatus provides a convenient and unobtrusive means for tracking individual or objects in a variety of applications, by integrating tactile sensory technology with a variety of conventional surfaces and network structures. The invention has the further advantage of being adjustable in size, to provide a custom-fit for every application.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations. Therefore, it is manifestly intended that this invention be limited only by the claims and the equivalents thereof.

What is claimed is:

1. A tactile sensory system, comprising:

a floor covering;

a tactile sensory layer having a plurality of sensors, the sensors selected from the group consisting of force sensors, proximity sensors, force-and-position-sensing resistors (FSR) and any combination thereof, wherein the tactile sensory layer comprises at least one data bus and at least one multiplexer for communicating a signal from the plurality of sensors to the controller and wherein the tactile sensory layer is integrated with the floor covering to form a tactile sensory surface, further wherein the tactile sensory surface or the tactile sensory layer can be manufactured in bulk on a roll and a section of the tactile sensory surface or tactile sensory layer can be removed from the roll and optionally adjusted in size; and a controller connected to the tactile sensory surface to track a person or object.

2. A tactile sensory system according to claim 1 wherein the floor covering is carpet or linoleum.

3. A tactile sensory system according to claim 1 wherein the floor covering is located in a residence or commercial building.

4. A tactile tracking system, comprising:

a first sensor positioned to sense pressure in a first location, the first location having a width resistor wire pair wherein resistivity across the width resistor wire pair increases when width of the first location decreases;

a connector coupled to the first sensor to identify sensor status within the location of the first sensor;

a second sensor positioned to sense pressure in a second location wherein the second location is separated from the first location, further wherein a length resistor wire pair is located between the first location and the second location wherein resistivity across the length resistor wire pair increases when distance between the first and second locations decreases, the connector coupled to the second sensor to identify sensor status within the location of the second sensor;

a node coupled to the connector to receive the information from the connector, the node capable of sampling the connector and extracting sensor status information; and a receiver coupled to the node to receive the sensor status information from the node, the receiver capable of tracking the pressure sensed.

5. A system according to claim 4 wherein the receiver receives the sensor status information at about the same time that the node samples the connector.

6. A system according to claim 4 wherein the first and second locations are rows.

7. A tactile tracking system according to claim 4 wherein the first location and second location are on a tactile tracking surface, further wherein the width of the first location is decreased when the tactile tracking surface is cut.

8. A tactile tracking system according to claim 7 wherein the distance between the first and second location is decreased when the tactile tracking surface is cut.

9. A tactile tracking system according to claim 7 wherein the first sensor and second sensor are piezo film sensors.

10. A method for tracking individuals, comprising:

activating at least one sensor in a tactile sensory surface to produce a signal, the at least one sensor selected from the group consisting of a force sensor, proximity sensor, force-and-position-sensing resistor (FSR), Hall-effect sensor, pyroelectric sensor, passive infrared sensor, sensor which detects arrival time of pressure waves, sensor which sends out timed sound waves, and any combination thereof;

communicating the signal to a multiplexer operatively connected to the sensor;

polling the multiplexer to determine sensor status using a node operatively connected to the multiplexer; and transmitting the sensor status to a central controller wherein the location of the individual is identified.

11. A method for tracking individuals according to claim 10 wherein the central controller is a computer having a display.

12. A method for tracking individuals according to claim 11 further comprising inputting commands to the computer with a user interface selected from the group consisting of a telephone, key pad, keyboard and touch screen.

13. A method for locally tracking individuals or objects with a tactile sensory system, comprising:

placing an electronic sensing device in a location within the tactile sensory system to sense an input, the input comprising at least one measurable process variable, wherein the tactile sensory surface is manufactured in bulk on a roll;

receiving the input from the electronic sensing device in a controller; and activating at least one component within the tactile sensory system when the input is received by the controller, the controller and electronic sensing device connected by a transmission link.

14. A method according to claim 13, further comprising outputting information from the controller to a third party device.

15. A security system, comprising:

a floor covering;

a tactile sensory layer integratable with the floor covering to form a tactile sensory surface having a plurality of rows, each row containing a plurality of removable polling sensors wherein the tactile sensory surface has hidden sensors for detecting the presence of an individual;

a removable polling row multiplexer at one end of each of the plurality of rows;

a controller connected to the tactile sensory surface; and an alarm system operatively connected to the tactile sensory surface, the alarm system capable of communication with a remote sensing station.

16. A security system according to claim 15 wherein the sensors are pressure sensors, further wherein the tactile sensory surface has at least one width resistor pair and at least one length resistor pair connected to the pressure sensors.

17. A security system according to claim 15 wherein the sensors are selected from the group consisting of force sensors, proximity sensors, force-and-position-sensing resistors (FSR), Hall-effect sensors, pyroelectric sensors, passive infrared sensors, sensors which detect arrival time of pressure waves, sensors which send out timed sound waves and any combination thereof.

18. A family tracking and automating system, comprising:

a floor covering;

a tactile sensory layer integratable with the floor covering to form a tactile sensory surface having a plurality of rows, each row containing a plurality of removable polling sensors wherein the tactile sensory surface has hidden sensors for detecting the location of an individual;

a removable polling row multiplexer at one end of each of the plurality of rows;

a controller connected to the tactile sensory surface; and a third party device connected to the controller wherein the controller outputs information to the third party device depending on the location of the individual, wherein the third party device is an appliance or light, further wherein a communication device is used by the individual to input commands from the individual to the controller to activate the appliance or light.

19. A family tracking and automating system according to claim 18 wherein the third-party device is selected from the group consisting of a light, appliance, static-electricity detector, light and heat detector, temperature sensor, humidity sensor, metal sensor, magnetic sensor, vibration switch, magnetic switch, infrared sensor, carbon monoxide detector, smoke detector, alarm device, sprinkler system, security system and digital weight scale.

20. A family tracking and automating system according to claim 18 wherein the communication device is an X-10 communication device.

21. A family tracking and automating system according to claim 18 wherein output signals from the appliance or light are viewable on a display connected to the controller.

22. A tactile sensory system comprising:

a floor covering;

a tactile sensory layer integratable with the floor covering to form a tactile sensory surface having a plurality of rows, each row containing a plurality of removable polling sensors;

a removable polling row multiplexer at one end of each of the plurality of rows; and a controller connected to the tactile sensory surface to track a person or object.

23. A tactile sensory system according to claim 22 wherein each removable polling sensor in a row can make a determination as to whether or not an adjacent removable polling sensor has been removed and communicate the determination to the removable polling row multiplexer.

24. A tactile sensory system according to claim 23 wherein each removable polling row multiplexer can make a determination as to whether or not the removable polling multiplexer in an adjacent row has been removed and communicate the determination to a node.

* * * * *

UNITED STATES PATENT AND TRADEMARK OFFICE

CERTIFICATE OF CORRECTION

PATENT NO. : 6,515,586 B1
DATED : February 4, 2003
INVENTOR(S) : Ben S. Wymore

It is certified that error appears in the above-identified patent and that said Letters Patent is hereby corrected as shown below:

Title page,
Item [56], References Cited, OTHER PUBLICATIONS, "Ayers, L.," reference, delete "System" and insert -- Systems' --, therefor.

Drawings,
Sheet 5 of 5, FIG. 5, insert --526 -- to indicate the figure at window 528.

Column 2,
Line 61, insert -- ( -- after "system".
Line 62, delete "device" and insert -- devices --, therefor.
Line 64, insert -- ) -- after "wiring".

Signed and Sealed this

Twenty-seventh Day of July, 2004

JON W. DUDAS
*Acting Director of the United States Patent and Trademark Office*